United States Patent [19]

Trysinsky

[11] Patent Number: 4,506,887

[45] Date of Patent: Mar. 26, 1985

[54] RACKET FRAME COMPRISED OF A SINGLE CONTINUOUS FILAMENT AND RESIN

[76] Inventor: Stanley Trysinsky, 3-10720-97th St., Edmonton, Alberta, Canada, T5H 2L8

[21] Appl. No.: 295,289

[22] Filed: Aug. 24, 1981

Related U.S. Application Data

[60] Continuation-in-part of Ser. No. 776,698, Mar. 11, 1977, abandoned, which is a division of Ser. No. 143,567, May 14, 1971, abandoned, which is a continuation-in-part of Ser. No. 1,991, Jan. 13, 1970, abandoned, which is a continuation of Ser. No. 599,355, Dec. 2, 1966, abandoned.

[51] Int. Cl.[3] ..... A63B 49/10

[52] U.S. Cl. ..... 273/73 F; 273/DIG. 23; 273/73 G; 273/73 J; 273/73 C; 156/172

[58] Field of Search ..... 273/73 C, 73 F, 73 G, 273/73 J, 73 K, 75, DIG. 7, DIG. 23

[56] References Cited

U.S. PATENT DOCUMENTS

| | | | |
|---|---|---|---|
| 1,122,159 | 12/1914 | Richey | 273/73 G |
| 1,470,878 | 10/1923 | Robinson | 273/73 D |
| 2,878,020 | 3/1959 | Robinson | 273/73 D |
| 3,483,055 | 12/1969 | Eshbaugh | 273/DIG. 7 |
| 3,582,073 | 6/1971 | Melnick et al. | 273/73 J |
| 3,625,512 | 12/1971 | Latham et al. | 273/73 C |
| 3,787,051 | 1/1974 | Johns | 273/DIG. 7 X |
| 4,082,273 | 4/1978 | Ellzey | 273/73 J |
| 4,203,596 | 5/1980 | Nagamoto | 273/73 F X |
| 4,355,803 | 10/1982 | Rama | 273/73 J |

FOREIGN PATENT DOCUMENTS

| | | | |
|---|---|---|---|
| 848826 | 8/1970 | Canada | 273/73 C |
| 33301 | 8/1981 | European Pat. Off. | 273/73 J |
| 1065765 | 9/1959 | Fed. Rep. of Germany | 273/73 C |
| 2010450 | 9/1971 | Fed. Rep. of Germany | 273/73 D |
| 1122895 | 8/1968 | United Kingdom | 273/DIG. 7 |

*Primary Examiner*—Richard C. Pinkham
*Assistant Examiner*—Matthew L. Schneider
*Attorney, Agent, or Firm*—Sughrue, Mion, Zinn, Macpeak and Seas

[57] ABSTRACT

The basic racket frame is comprised of an oval head, a yoke merging into a throat and a solid or a hollow shaft which is formed from a single length of collimated filaments preferably graphite fibers, known as a roving impregnated with a thermosetting resin. To form the racket frame, the single length of roving is wound up the handle, around the entire circumference of the head and back down the handle. This winding technique forms a hollow handle to which is attached a hollow, removably interfitting grip portion. This grip portion is then fitted with a cover consisting of stretchable, cylindric bands. The racket frame also includes a throat piece comprised of a plastic insert covered on opposite faces by a mat of filaments. The filaments in this mat are positioned parallel to the filaments in the handle.

6 Claims, 32 Drawing Figures

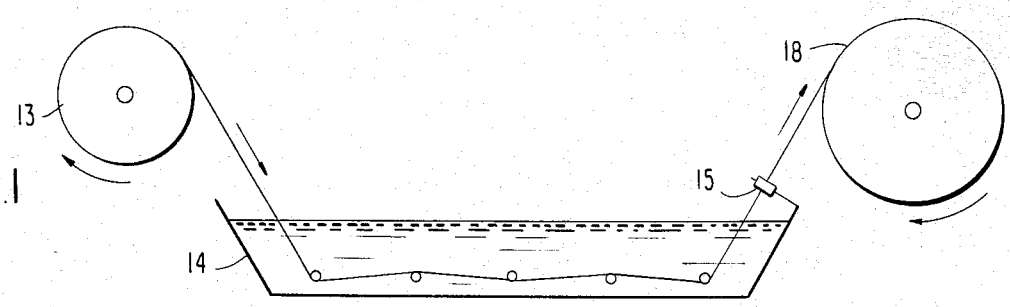
FIG. 1
FIG. 2
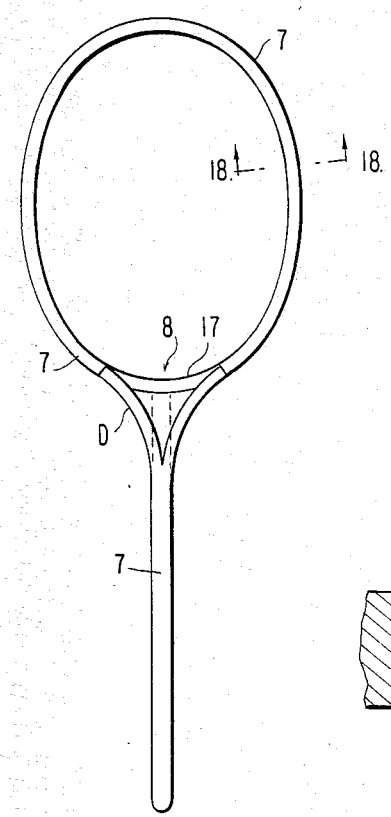
FIG. 3
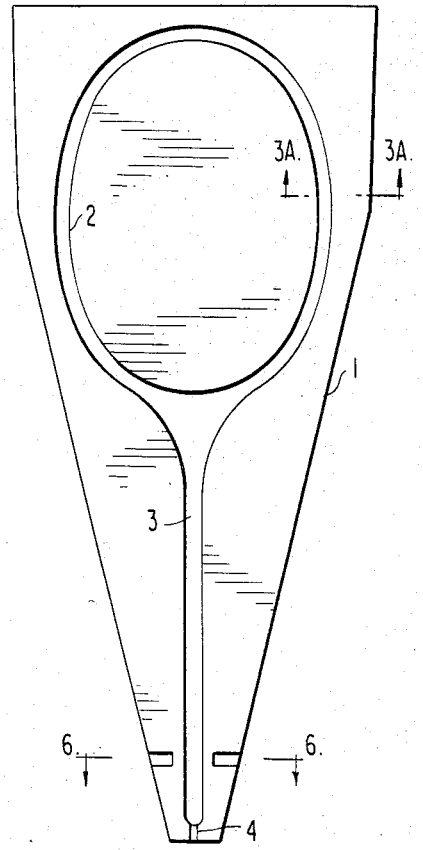
FIG. 3A
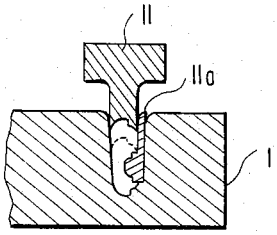
FIG. 6
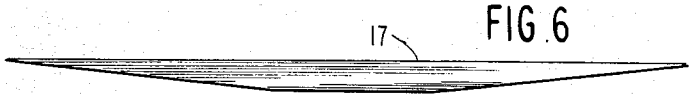
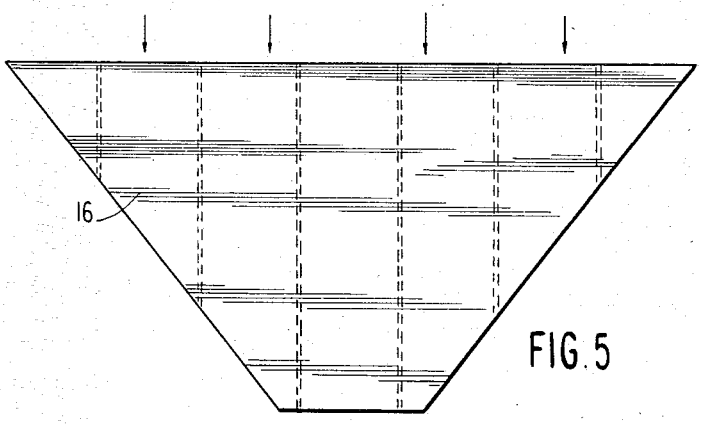
FIG. 5
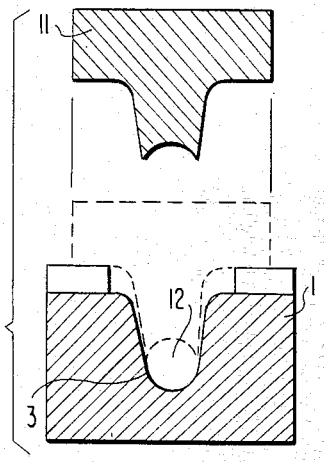
FIG. 4

FIG. 7
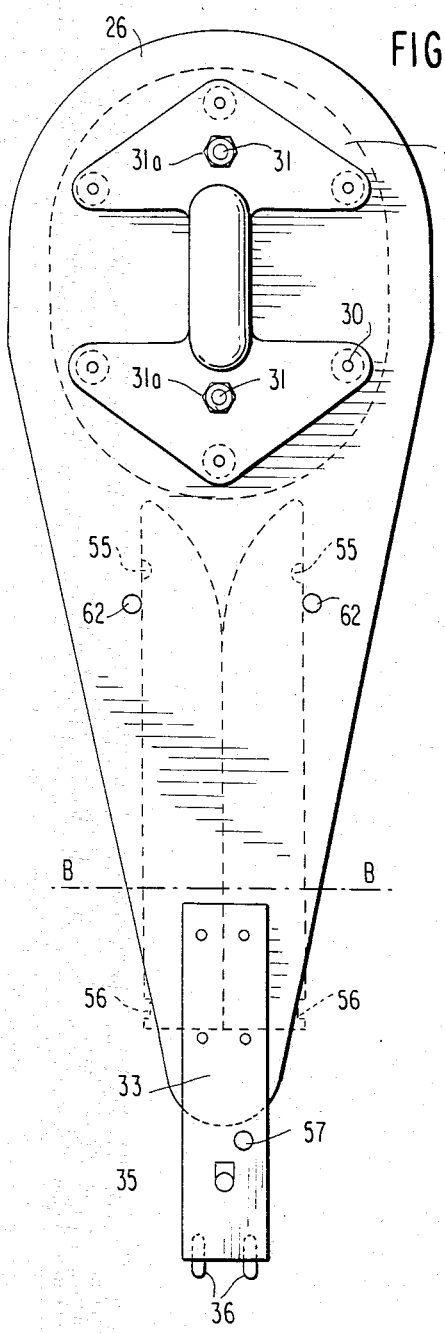
FIG. 10
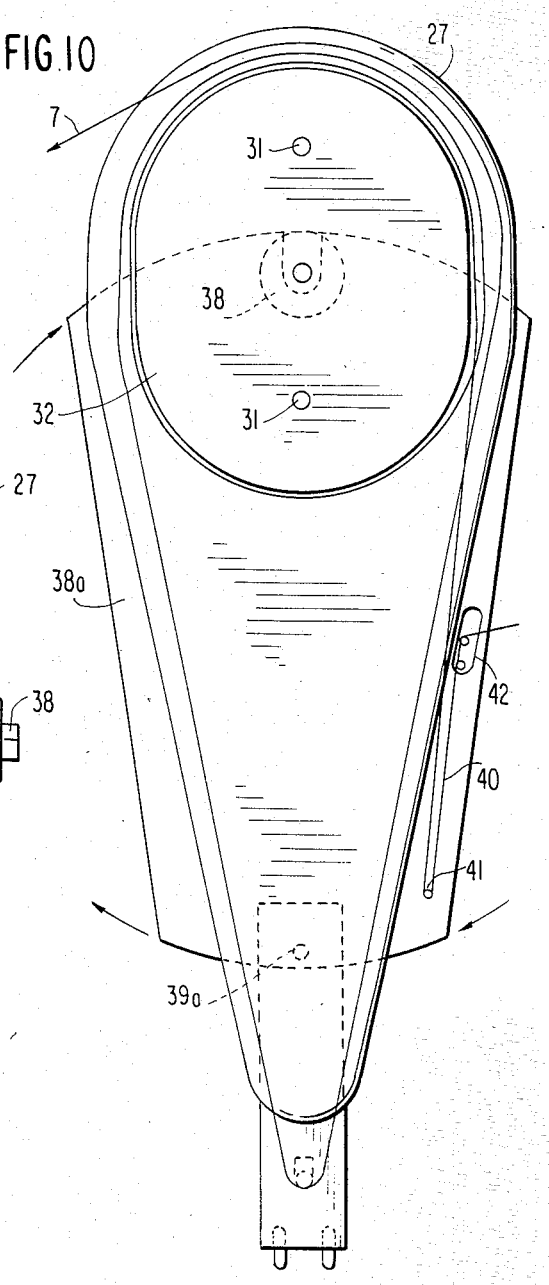
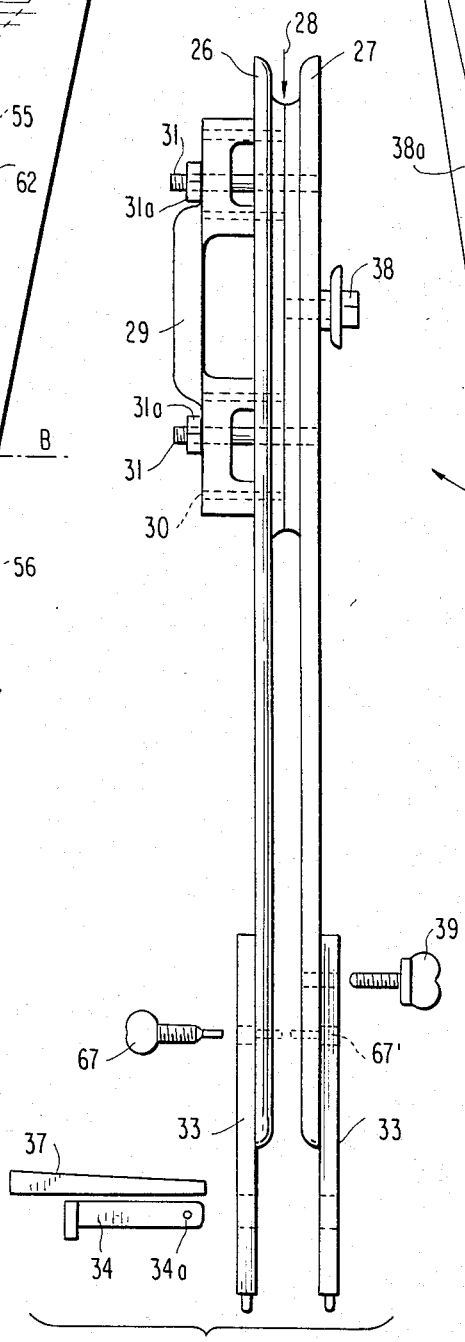
FIG. 9
FIG. 8
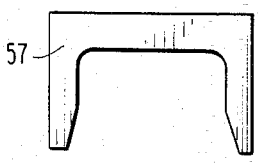

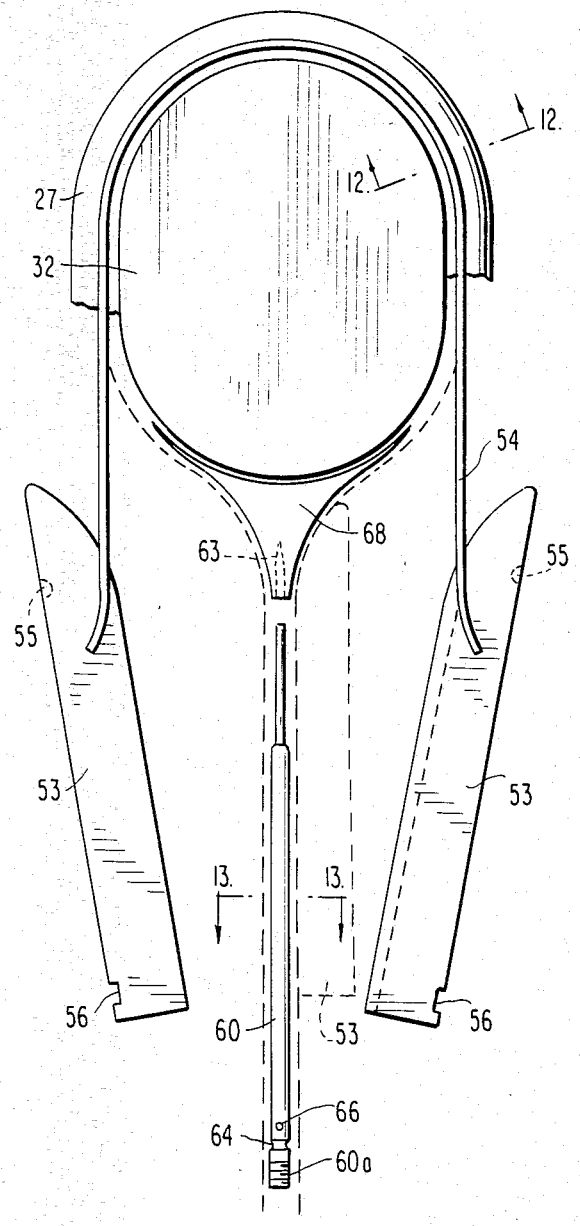
FIG. 11
FIG. 12
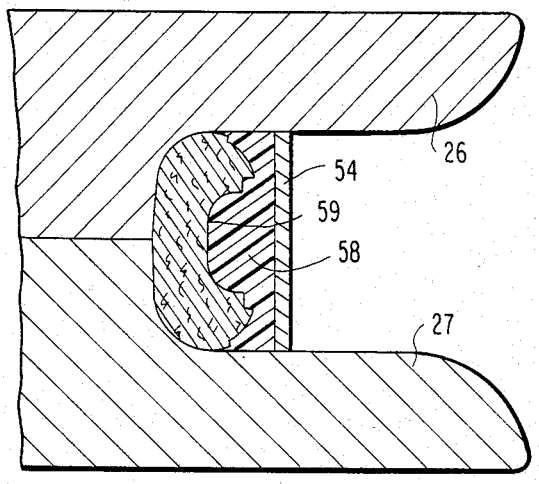
FIG. 13
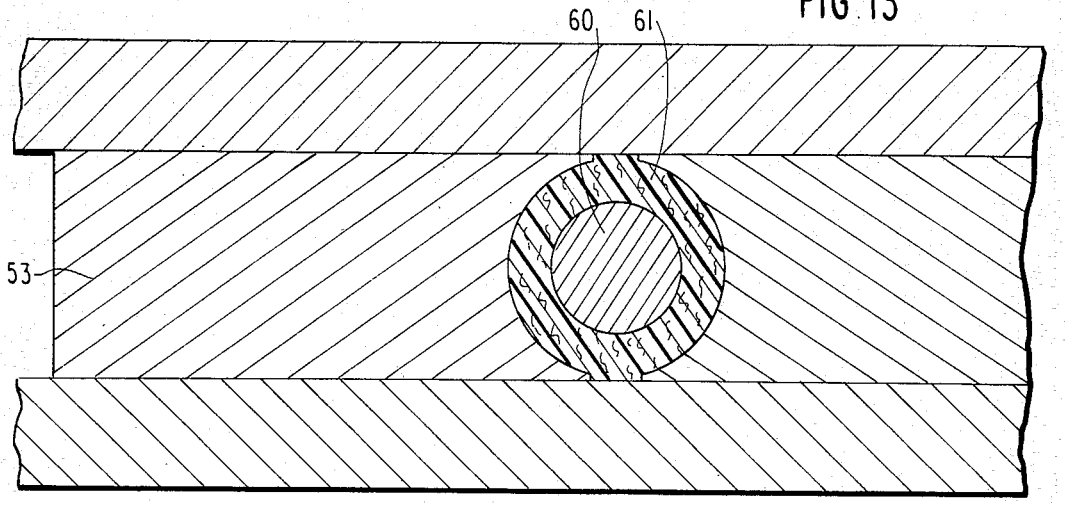

87
86
16
89
61
61b
71
75o
74
77
75
73
73'
72
76

RACKET FRAME COMPRISED OF A SINGLE CONTINUOUS FILAMENT AND RESIN

CROSS-REFERENCE TO RELATED APPLICATIONS

This application is a continuation-in-part of application Ser. No. 776,698, filed Mar. 11, 1977 in the name of Stanley Trysinsky and entitled "Racket Frame and the Production Method", now abandoned which is a division of application Ser. No. 143,567,filed May 14, 1971, now abandoned, which is a continuation-in-part of application Ser. No. 1991, filed Jan. 13, 1970, now abandoned, which was a continuation of application Ser. No. 599,355, filed Dec. 2, 1966, now abandoned.

BACKGROUND OF THE INVENTION

The present invention is directed to rackets manufactured from thermosetting resin-impregnated collimated filaments of glass, carbon or graphite fibers.

The use of fibers and a thermosetting resin is well known in the art. A considerable number of structures have been made by a variety of methods using a plurality of separate lengths of roving and using a hand lay-up of material into or onto stationary compression type molds. Some methods use no tensioning at all, while others use forms of tensioning which are non-balanced, non-maximized and in only part of the frame structure. Some basically wood racket designs use a small amount of the materials mentioned as an interlay or overlay with no tensioning. No case is known where the entire basic frame is made from one single length of roving material, machine wound into a solidly closed loop having a racket configuration and bonded integrally into a solid state of balanced, maximized pretension througout the entire basic filament structure to yield an increased strength with a lower than ever weight of material.

In the racket art it is customary to provide rackets in a great number of separate models varying as to total weight, balance, handle size and shaft stiffness. Despite changing from one racket to another the player very often cannot find a model having the exact combination of the variables to best suit his physique, strength and style of play.

In order to make rackets of adequate strength for muscular strong players by prior art methods, one must use a detrimentally excessive weight of material particularly in the lower head, yoke, shaft and handle portions. Lighter weight rackets in the prior art simply do not have the strength and stiffness necessary for an ideal ball-striking implement. In prior art rackets, the distribution of weight of the material is very poor. For example, in wooden frames, a number of plies or layers are glued together after being curved around to form the oval head. These same layers define the yoke and then merge together at the throat and extend on to form the shaft and integral handle. Cutting out of a given length anywhere along the racket across the entire width will remove the same number of ply pieces of the same weight. Hence, the weight of structural material is seen to be evenly distributed along the rackets length. This is analogous to weight distribution in a steel bar of uniform cross-section. In using this bar as say a nail driving implement, the most effective point of nail impact or "sweet spot" is found at a point two-thirds of the bars length away from the hand-held end. This is a clumsy implement indeed when compared to a proper highly effective energy saving hammer having nearly all of it's weight positioned in the head and evenly around the point of nail impact with no significant amount of ineffective, energy wasting, balance-disturbing excess weight elsewhere.

Despite the availability of the new high specific strength materials, current racket designs still imitate the inefficient wooden racket structures in regard to the bar-like distribution of weight in both single and twin shafted models. Full advantage is not taken of the qualities of the new materials to produce a more efficient ball-driving implement. Bar concept designs produce a "sweet spot" location practically touching the bottom of the head frame material. Hence, the ball must be struck nearer to the center of the head well away from the point-losing, wood-shot sweet spot location. This is safer but much less effective in ball stroking because of the significantly lowered coefficient of restitution or transfer of muscular energy to the ball so far away from the actual sweet spot location.

The "perfect" racket would hypothetically have all of it's weight uniformly distributed around only the periphery of the oval head. The sweet spot would then be located in the exact geometric center of the head. The shaft stiffness would be adjustable to the degree preferred by the player. The shaft would be weightless which, of course, is impossible. However, the lighter that the yoke, shaft and handle can be made, the closer we come to perfect racket balance and maximum ball driving effect from a given expenditure of muscular energy. This is a great boon for lighter muscled, fast moving players.

For best possible results a player's particular needs should be met by adjustment to achieve a suitable combination of the following variables: (a) Total racket weight; (b) Weight balance; (c) Handle size; (d) Shaft stiffness; and (e) Kind of strings and stringing tension. The prior art tries to meet the need by providing a vast and confusing variety of models in different weights with different balances having different handles integral with the frame with different shaft stiffnesses. No dealer can possibly carry every possible combination of these variables in a huge inventory. Therefore, the buyer often cannot find the racket best for his physique and style of play.

SUMMARY OF THE INVENTION

The present invention takes the fullest advantage of modern fiber materials and specific combinations of structure and production methods to produce a most efficient, adjustable and affordable racket having superlative qualities in play and otherwise. The sweet spot is now very near to the center of the head. With ineffective weight removed and maximum streamlining, muscular energy is now conserved for better control of strokes and for greater endurance in play. The superbly light yet adequately strong, stiff shaft is achieved by combined factors of type and condition of material and shape design. Since this invention produces an adequately strong racket of a heretofore unattainable very light weight it enables the placement of low cost materials of suitable weight to be attached around the head for the proper hammer-like effect.

The present invention provides a single standard racket model which in itself is adjustable with respect to all the variables stated above. All adjustment means are very smooth, strong and inconspicuous and the adjustments can be made by anyone.

The present invention also provides higher streamlining, combined renewable means for protection against racket wear by accidental hard court contact, easily interchangeable handles of different sizes and oval-shaped, more easily applied standard handle covers or grips.

BRIEF DESCRIPTION OF THE DRAWINGS

FIG. 1 is a schematic view of the wetting tank for impregnating the roving with resin.

FIG. 2 is a view of the racket as it comes from the mold after curing.

FIG. 3 is a plan view of one mold half showing the groove in the shape of a racket.

FIG. 3A is a sectional view taken along the line 3A—3A in FIG. 3 and further showing the mating mold half and insert piece.

FIG. 4 is a sectional view taken along the lines 6—6 of FIG. 3 and further showing the mating mold half.

FIG. 5 is a plan view of the varying length fibers used to form a cross brace.

FIG. 6 is a plan view of the fibers shown in FIG. 5 subsequent to being compacted to form the cross brace.

FIG. 7 is a plan view of the combination winding mandrel and mold for constructing the racket according to a modification.

FIG. 8 is a plan view of the U-shaped locking bracket adapted to hold the mold parts together.

FIG. 9 is a side view of the combination winding mandrel and mold shown in FIG. 7 with several parts shown in exploded relationship.

FIG. 10 is a plan view showing a schematic winding arrangement of the roving as it is wound on the mandrel.

FIG. 11 is a partial plan view of the mandrel of FIG. 7 with several parts removed and showing the relationship of the compression members relative to the mandrel.

FIG. 12 is an enlarged sectional view taken along the line 12—12 of FIG. 11.

FIG. 13 is a sectional view taken along the line 13—13 of FIG. 11 with the compression molding members and the mandrel halves being in the closed molding position.

DETAILED DESCRIPTION OF THE INVENTION

Figure 14A:
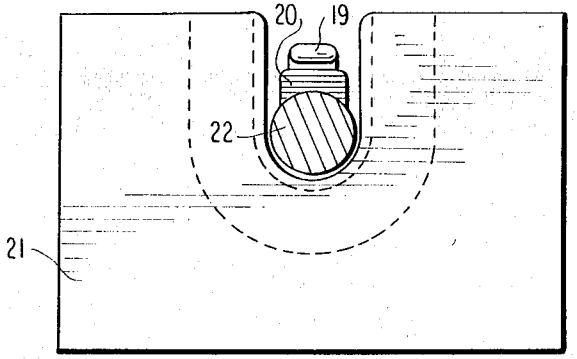
FIG. 14A is a sectional view taken generally along the 17—17 of FIG. 14.

The racket frame according to the present invention is made basically of fiber components together with a suitable thermosetting resin. Although the best results are obtained by the use of graphite filaments or fibers in the form of a roving, other fibers such as glass also produce good results. Epoxy resin is the preferred bonding component. Other thermosetting resins can also be used with similar results. To obtain the highest strength with suitable stiff flexing action in the frame, the percentage of fibrous elements in the structure must be high, ranging from 65% to 80% with 70% being the optimum.

According to the first embodiment of the invention, a single piece or length of roving is wound into a loop after passing through a wetting tank filled with resin in liquid form. The roving is taken from a supply roll 13 as shown in FIG. 1 and passed through the liquid 14 along a tortuous path over and under a plurality of pins. Upon leaving the liquid the roving is passed through a squeeze roller arrangement 15 and is wound into a loop having the desired number of turns on the spool 18. The starting and finishing end of the roving are securely and permanently knotted together to provide a solidly closed multi-turn loop. In practice it is found that a bare basic tennis racket frame can be produced with increased strength and stiffness at an amazing eight ounce weight using 252 turns of "Thornel" 300 carbon fiber grade WYP 15 1/0 which is a continuous length high strength, high modulus fiber consisting of 6,000 filaments in a one-ply construction. Adding the light handle part and grip material the weight is only 10.7 ounces which is under the very lightest wooden racket weight. Yet strength and stiffness tests out equal to a heavy 13½ ounce wooden racket.

Figure 14:
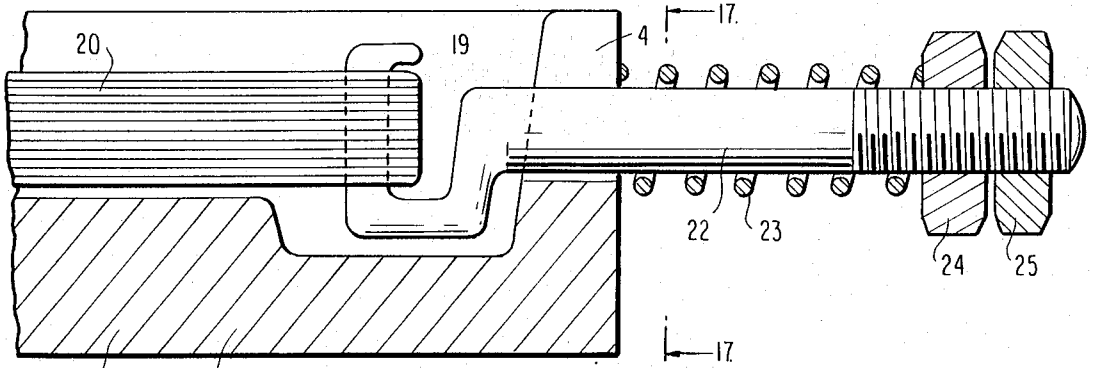
FIG. 14 is a side elevational view, partly in section showing the filament tensioning means usable with the mold of FIG. 3.

The spool or form 18 may be warmed to a suitable degree by any conventional heating means (not shown). The form 18 may be separated to facilitate the removal of the somewhat sticky loop which is then laid into the warmed mold 1 of FIG. 3 with the knot disposed at the end of the shaft cavity at 4. Metal hand tools for moving the loop from spool to mold are pre-warmed to facilitate smooth transfer with no sticking of cooled resin or fraying, unravelling or distorting the collimation of the fibers. It is very convenient to place the hooked end of the tensioning device 19 shown in FIG. 14 within the loop at the spot where the knot is located and use the device as one of the hand tools to place both the loop and the device itself, in one motion, into the correct position in the open slot 4 at the end of the mold. The rest of the loop is also guided smoothly into the mold.

The upper half 11 of the mold is next placed into the mold cavity 1 and pressed down to define the top face of the racket while squeezing out the slight excess amount of impregnating resin. The mold and contents are heated further by an orthodox means to cure the completely uniform and maximally tensioned frame-loop into a solid integral frame.

In this mold the shaft may be produced as a slender solid rod or, by using a removable core-rod, the shaft can be made as a hollow, collimated, tensioned fiber tube. In order to add strength in the area of the yoke a cross-brace of suitable fibers is prepared by cutting a piece of flat collimated fiber material into the shape 16 shown in FIG. 5. This piece of resin impregnated material is next compacted together in the direction of the arrows to form the neat tapered bundle 17 in FIG. 6. This collimated fiber bundle is next placed in the mold cavity at the yoke and lower head position to further collimate and intermesh the ends of the fiber bundle between the fibers of the main loop. Curing this finely tapered double ended scarf joint produces a high strength integral racket structure. The shafts are made to have a standard precise outer sized end. Handles are made separately in different hand-sizes but with a standard central hole diameter to ensure a snug, secure, interchangeable fit on the shaft. During molding a suitable mold insert member 11*a* is used to form a recessed groove into the outer surface of the racket head. The insert 11*a* extends about a major portion of the head with the ends terminating adjacent the yoke on each side of the head.

In a further embodiment shown in FIGS. 7 to 12, a combination mandrel and mold is utilized which avoids the cumbersome and time consuming transfer of a wetted loop from a spool into the mold cavity. As in the previous embodiment a continuous fiber roving is unwound from a supply spool through a tank where it is thorougly wetted with a thermosetting resin by passing over and under a considerable number of smooth polished metal pins which also squeeze out all the trapped air bubbles. Excess resin runs back into the tank from a pair of squeeze rollers between which the roving passes. The wetted roving is then smoothly collimated while being wound on the head-defining part of the mandrel-mold. The tension is caused by the frictional resistance or braking effect of the wetting tank parts. The rotary mandrel shown in FIG. 7 also serves as a major portion of the mold. The portion 32 is made of a metal (for example aluminum) which expands more on heating than does the roving, which is wound snugly around it. Thus, the turns of the loop wound on it are subjected to a maximum degree of further equalized tensioning during cure. The combination rotary mold-mandrel is comprised of an outer half 26 and an inner half 27. The parting or separation line is indicated at 28 and a cast metal stiffening spider and handle 29 is attached to the upper mold half by means of six screws 30. Two screws 31 are tightly secured to the inner half but pass freely through the outer mold half and spider. Two nuts 31*a* are threaded onto the screws 31 to clamp the mold halves rapidly and securely together. The raised oval portions 32, integral with each mold half, define the inner surface of the head portion of the racket frame. End bars or plates 33 are attached by means of screws to the outer and inner mold halves. A polished steel pin 34 is designed to be inserted through the apertures 35 in the ends of the outer and inner halves to provide a post for winding the major loop of the racket. A wedge pin 37 is also insertable in the opening to secure the pin 34 in place. An additional retaining pin (not shown) may be inserted through the hole 34*a* to hold the pin in position. Two hardened dowel pins 36 are secured in the end of each plate 33 for mounting the tensioning device hereinafter described. A fastening device 38 comprised of a nut, a spacer and a washer threaded onto a screw member protruding from the inner mold half 27 is utilized for mounting the mandrel onto the filament winding machine. The plate 38*a* which is attached to the filament winding machine by any suitable means is provided with a notch at the upper end for the reception of the fastening means 38. An opening 39*a* is provided in the lower end of the plate 38*a* for the reception of a screw member 39 to secure the lower end of the mandrel to the plate 38*a*.

Figure 15A:
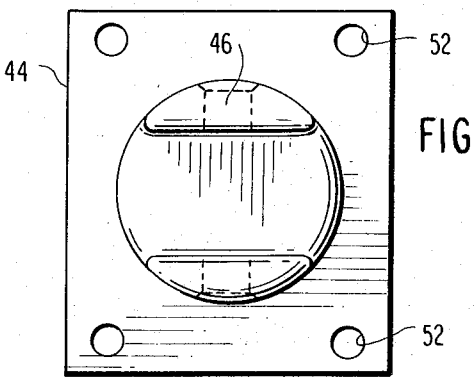
FIG. 15A is an end elevational view of the tensioning device of FIG. 15 as viewed from the left.
Figure 15:
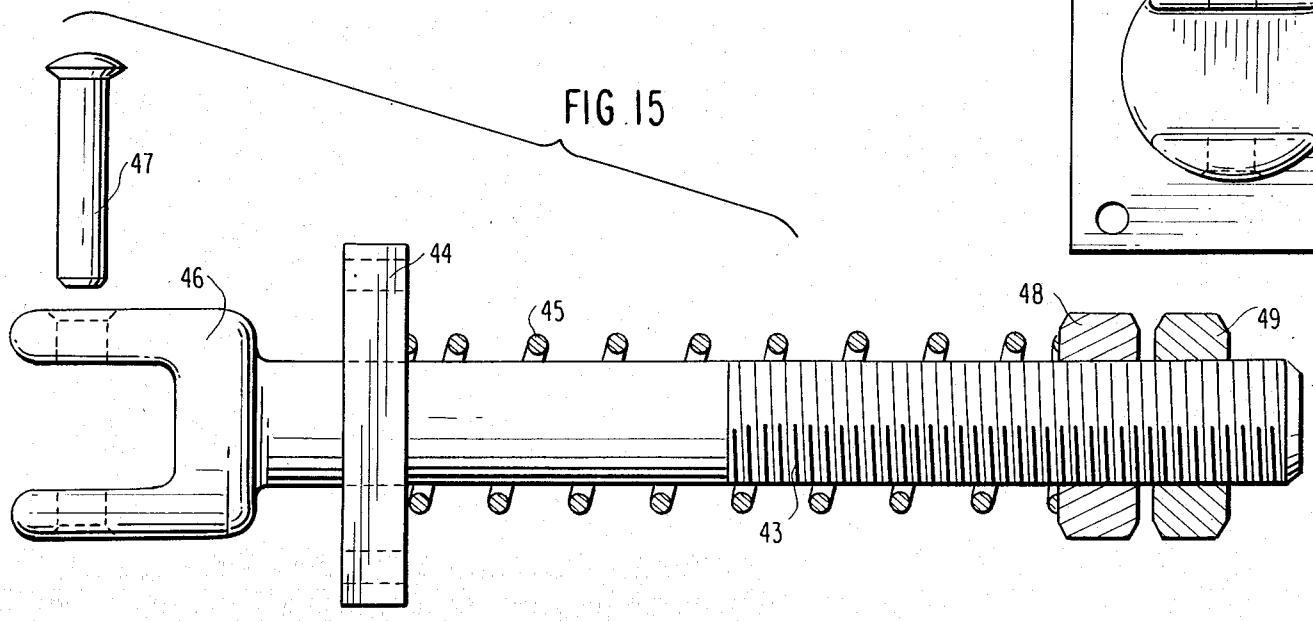
FIG. 15 is an exploded perspective view, partly in section, of the tensioning means usable with the mandrel of FIG. 7.

A spring clip 42 is secured to the face of the winding plate 38*a* and is adapted to hold the free starting end of fiber during the winding of the fiber onto the mandrel. Initially, the pin 34 and the wedging pin 37 are removed from the mandrel and the fiber 40 will extend from the spring clip 42 around a pin 41 on the winding plate 38A and around the raised portion 32 of the mandrel. A predetermined number of turns are wound about the raised portion 32 to define the oval head portion of the racket. Winding is stopped and core materials (detailed further on) are inserted between the mold plates. Pin 34 is then secured in place by means of wedge 37 and winding is resumed to form additional elongated turns from the same length of fiber roving to further build-up the head portion of the racket and enclose the core materials while encompassing the winding pin 34 to provide fiber for the shaft portion of the racket frame. On completion of a predetermined number of turns, the starting end is removed from it's holding clip 42, the finishing end is cut and the two knotted securely together under the pin 34 to form a permanetly closed solid endless loop. The tensioning device shown in FIGS. 15 and 15*a* is then substituted for the pin 34. The tensioning device is comprised of a threaded rod 43 passing freely through an end plate 44 and having a compression spring 45 disposed in surrounding relationship thereto. An adjusting nut 49 and a lock nut 49 are threaded on the end of the rod 43 and compression spring 45 extends between the plate 44 and the adjusting nut 48. The end plate 44 is provided with four holes 52 which fit over the four pins 36 on the ends of the plates 33 secured to the mandrel. The rod 43 is provided with a clevis 46 at one end into which a pin 47 fits securely by light tapping.

To attach the tensioning unit to the mold, tapered pin 37 is removed to allow a small upward loop-slackening movement of the pin 34. The clevis 46 is next applied between the mold end bars 33 so that it surrounds the loop material, clevis holes are lined up with access hole 35 and the clevis pin is tapped into place. Pin 34 is now removed and the loop is left slackened temporarily with no tension applied by the device. The foregoing procedure is necessary to prevent the lower side portions of the loop from being pushed and stuck together when the clevis is pressed against them, thus insuring a clear space for the short clevis pin 47 to be properly placed within the central space of the lower loop.

The outer shape defining means are next applied as shown in FIG. 11. These shape defining means are comprised of integrally assembled outer-shaft defining bars 53 which may be of steel. These bars have narrow curved slots into which the spring steel strip 54 is securely attached by silver soldering or other suitable means. The bars 53 are also provided with conical recesses at 55 for receiving the ends of a clamp (not shown) to compress the bars tightly againt the shaft structure of the racket. The bars 53 are also provided with slots 56 to receive a precise U-shaped locking member clamp 57 shown in FIG. 8. The strip 54 may be made from resilient spring steel material. A strip 58 of more easily fabricated TEFLON may be bonded to the thinner steel strip 54 to provide a flexible mold member. The TEFLON strip 58 is formed with a raised ridge 59 which when pressed into the soft wetted fiber loop will define the groove about the head portion of the racket for the recessing of the racket strings. This specific arrangement is best shown in FIG. 12.

Figure 19A:
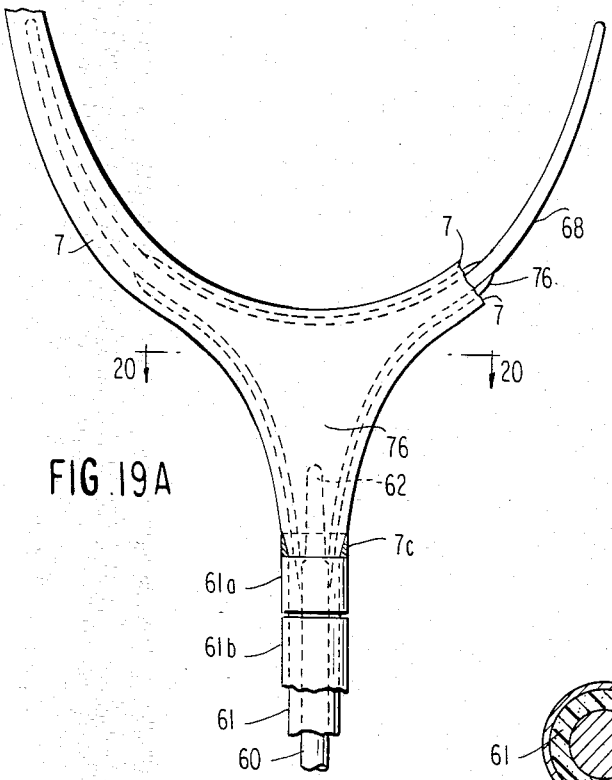
FIG. 19A is a partially cutaway plan view of the yoke area showing details of the core, narrow metal band and long metal tube.
Figure 19B:
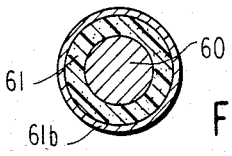
FIGS. 19B is a sectional view of the handle portion of FIG. 19A.
Figure 20A:
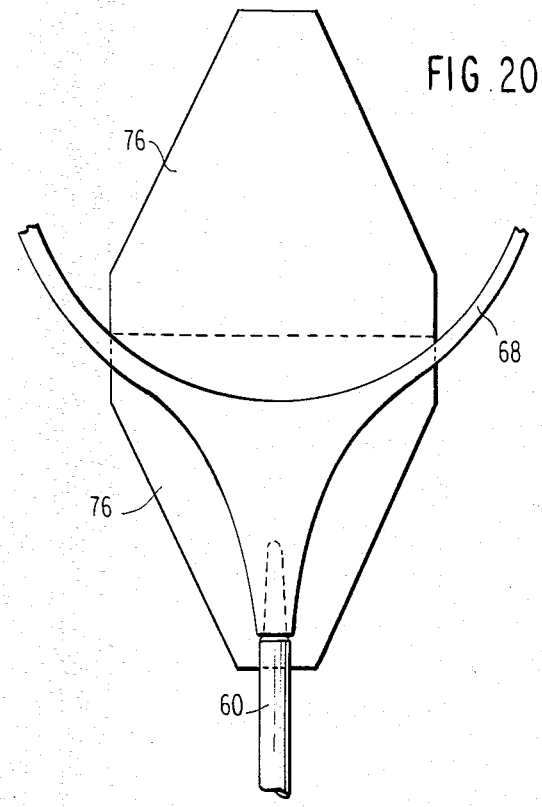
FIG. 20A is a plan view similar to FIG. 19A showing the liquid resin wetted pressure flowable fiber felt priort to being folded.
Figure 20:
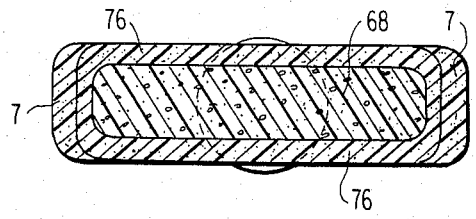
FIG. 20 is a sectional view taken on the line 20—20 of FIG. 19.

A removable TEFLON-covered steel core rod 60 having a throat piece 68 of rigid polyurethane foam detachably mounted on the end 63 thereof is placed within the lower end of the fiber loop. A resin impregnated fiber mat 76 is laid over the throat piece as shown in FIGS. 19 and 20A with the filaments disposed substantially parallel to the filaments defining said handle. When the side bars 53 are pressed into position the fibers will be moved around the core rod 60 and throat piece 68 to shape the shaft 61 as shown in the sectional view of FIG. 13. On completion of the elongated loop, tensioning means are attached as previously described. The outer shape defining means are now loosely hung between plates 26 and 27 as in FIG. 11 to contact the loop fibers at the top of the head and begin pressing them into the shape shown in FIG. 12. The side portions are next pressed inwardly by hand between the plates to contact the edges of the fiber loop which is still not tensioned. Clamping pressure is applied at points 55 of bars 53 to press the members toward each other to press the fibers in the loop and throat area together. A slight tension now begins to develop due to the shortening action in the loop caused by the pressure against the clevis 46. After the side bars 53 are pressed in, to the correct distance, they are retained in place by locating pins through holes 62 in both mold halves. (FIG. 7). The compressing clamp is now removed. The bottom ends of the side members 53 are now brought together and held in place by clamp 57 pressed into slots 56.

Further tensioning is now applied to the closed loop by turning the nut 48 and locking the adjusted position with nut 49 (FIG. 15). The mold with it's enclosed material is quickly detached (release screw 39) and lifted out of slot 38 (FIG. 10) and placed in an oven to cure while the next mold is being wound.

After curing the screw pins 67 shown in FIG. 9 are removed from engagement with the recesses 66 and the mold disassembled in the reverse order of original assembly to separate the mold halves and remove the cured racket frame. The core rod 60 is exposed for pulling by sawing around the fiber shaft into the clearance groove 64 and pulling the fiber stub off. After this an impact type of core puller is screwed onto the threaded end 60*a* of the exposed shaft core and removes it. In some embodiments it is contemplated to leave a very lightweight rod-core member permanently in the shaft to save cutting and removal work.

In FIG. 19, a short band of high strength aluminum tubing 61*a* is preheated, dropped over and by cooling shrunk very tightly around the shaft for extra reinforcing of the throat. A resin rich ring 7*c* is molded around shaft 61 which provides a flush fit for the metal band 61*a*. A precisely fitted longer second piece 61*b* of the same type of tubing is pushed over the remainder of the shaft 61 to greatly stiffen it. This tube extends into contact with the end of the attached handle but is not a part thereof. This feature meets the needs of very strong players who have the physique to handle a very stiff racket adapted to their kind of speed and power style of play.

Figures 16A, 16B, 16C, 17A, 17B, 21A, 21B, 22A, 22B:
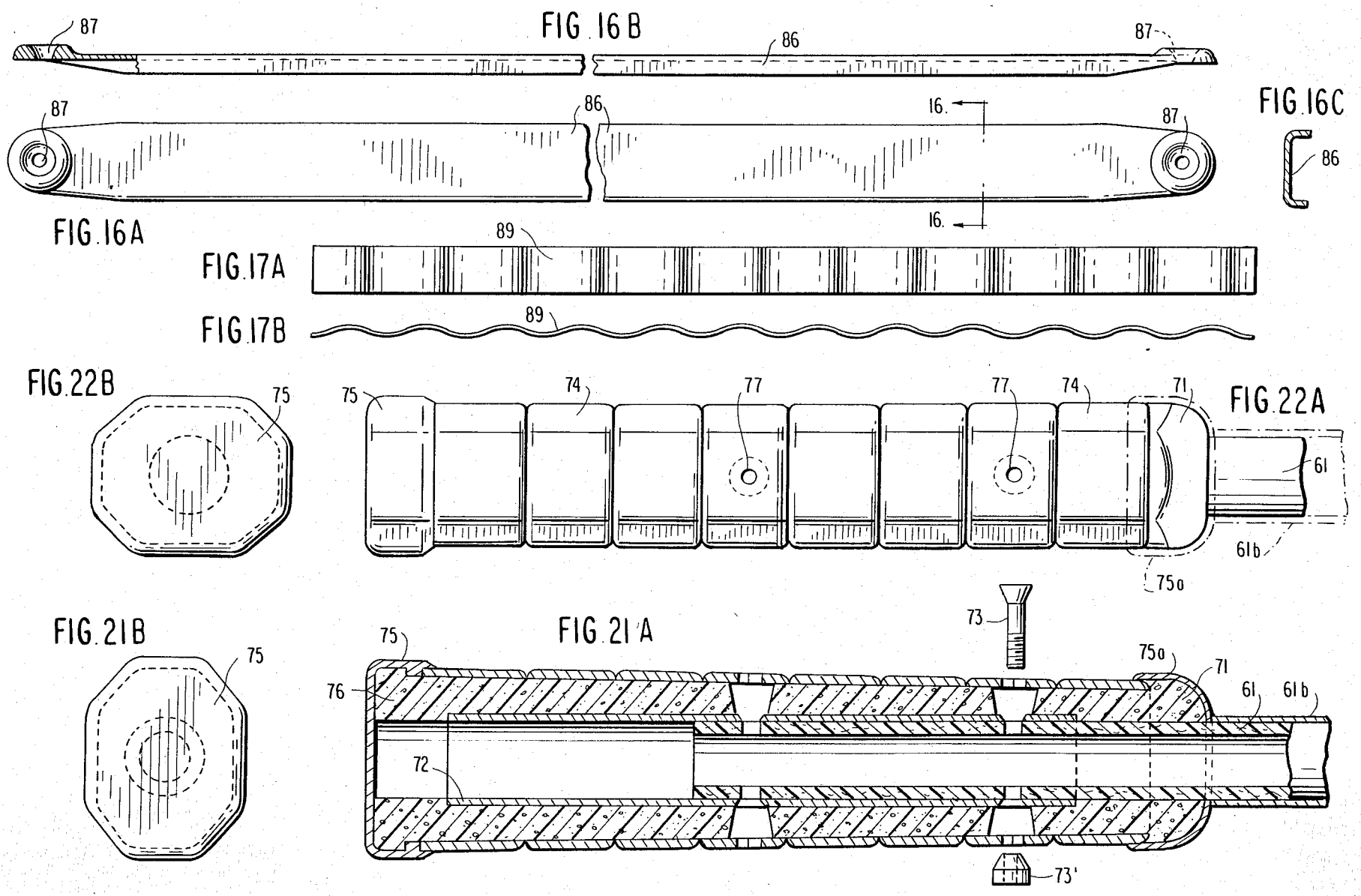
FIGS. 16A, 16B and 16C show a plan view, a partial section side view and a sectional view taken on the line 16—16 of the weight adjusting band, respectively, prior to the band being formed into an oval shape.
FIGS. 17A and 17B show a top and side view, respectively, of a short piece of the thin corrugated balance adjusting strip.
FIGS. 21A and 21B are sectional views of the handle structure and an end view from the left, respectively.
FIGS. 22A and 22B are a side view of the grip rings and end cap applied over the handle and an end view from the left, respectively.
Figure 18:
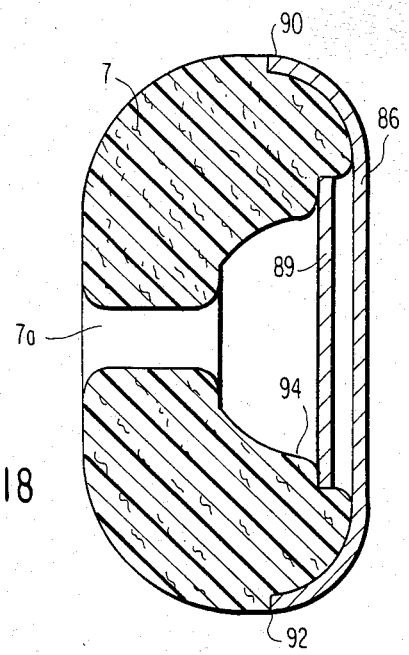
FIG. 18 is an enlarged sectional view taken on the line 18—18 of FIG. 2 of the racket head showing also the weight adjusting band and the narrower corrugated balance adjusting strip in place.

FIGS. 16*a*, 16*b* and 16*c* show side, plan and end section views of the head band 86 which in use is formed in an oval shape to coincide with the outer surface of the racket head. The band's ends reach to each side of the yoke portion of the frame and are detachably yet securely fastened thereto by tapered head screws passing through holes 87 and into threaded holes in the yoke. The tapers pull the band very tightly around and onto the recesses 90 and 92 in racket head on opposite sides of the groove 94 as seen in FIG. 18. The stiff flexible curved edges of the band, being formed somewhat narrower than the rackets edge, are forced out by the pulling around action of the screws to ensure very secure fit and hold. These bands are made of different thicknesses of metal and/or strong tough plastic material such as polycarbonate. By interchanging these bands of different weights the head weight and total weight can be adjusted to exactly suit the player. The band also serves as a shape-smoothing or streamlining means as well as a renewable protection means against scuff damage by accidental court contact. FIG. 18 shows the positions of band 86, strip 89, fiber 7 and string hole 7*a*.

FIGS. 17*a* and 17*b* show a plan and side view of the narrower inner strip 89 which is held in position under the main outer band 86 as shown in FIG. 18. Strip 89 has standard shallow corrugations across the width thereof so that a plurality of these strips 89 may interlock together when overlapped. One or more of the strips 89 of different lengths may be placed at different positions around the head either singly or overlapped together in various combinations of length, amount of overlap and position on the head. This extra weight positioning adjusts the balance and feel to suit a player's preference.

The handle as shown in section in FIG. 21 is made in several sizes as commonly measured about the octagonal circumference. The length is adequate for even the popular two handed grip. The actual handle 71 is premolded of light but very strong hard "skinned" cellular material. Rigid polyurethane of medium density (30 P.C.F.) is satisfactory. A piece of very light strong aircraft aluminum tubing 72 is solidly bonded to the cellular material 71 with four precisely drilled and bevelled holes located in a standard position on all the handle sizes. Precisley corresponding holes are drilled through the shaft 61.

Two tapered head screws 73 pass through both handle and shaft. The tapers on screw 73 and nuts 73' lock securely into the bevelled holes of the metal tube.

The handle covers 74 provide a unique concept for rackets and obviate the onerous tacking, cementing, awkward spiral wrapping and taping of the orthodox long strips of grip materials. FIG. 22 shows a plurality of identical cylindrical bands 74. These are made in a standard wall thickness and standard internal diameter of a stiff elastic polymeric material having sweet dissipating wicking, easy secure gripping, and durability qualities far superior to leather. This design allows slight stretching on application of the bands 74, one at a time, to conform to and hold securely on the octagonal shaped handle. The degree of elastic recovery is adequate to hold the bands firmly in place on all the sizes of the handles. Larger sizes require a small amount of strain to enlarge the diameter during application. However, the degree of elastic recovery is still correctly adequate to hold the band very fimly in place on the racket. A round cup-shaped end-cap 75 of the same materials is dimensionally designed to properly stretch over the end of the handle and lock securely over the raised integral ridge or collar 76 near the lower end of the handle. 75*a* is a similar cupshaped end cap, for the top of the handle, having a hole at it's center to accomodate the shaft 61. Small slitted holes 77 in two of the bands facilitate the insertion of screw, nut and tightening tools during assembly while concealing the assembled screws and nuts.

While the invention has been particularly shown and described with reference to preferred embodiments thereof, it will be understood by those in the art that various changes in forms and details may be made therein without departing from the spirit and scope of the invention.

What is claimed is:

1. A racket frame comprising comprising a handle portion, a throat portion and a head, said handle portion, throat portion and head being integral and consisting essentially of thermosetting resin means reinforced with a single continuous filament means disposed in a plurality of windings which are arranged parallel to each other under tension and which extend along said handle portion, around the entire circumference of the head and back along said handle portion to define a hollow handle, said single continuous filament means having two ends secured together and including a throat piece comprised of a ,rigid plastic insert surrounded completely on each side by said continuous filament means with the opposed faces covered by a mat of filaments disposed substantially parallel to the filament means defining said handle.

2. A racket frame as set forth in claim 1 further comprising a hollow cylindric one, piece handle grip of plastic material, means detachably connecting said handle grip to said hollow handle and cover means detachably connected to said handle grip.

3. A racket frame as set forth in claim 2 wherein said cover means is comprised of a plurality of stretchable cylindrical bands mounted on said handle grip in abutting relation and elastically gripping said handle grip.

4. A racket frame as set forth in claim 1 further comprising a string receiving groove extending substantially about the entire circumference of said head, recesses located in the outer circumference of said head along opposite sides of said groove, a flexible band having a U-shaped cross-sectional configuration substantially complementary to the outer surface of said head located in said recesses over said groove and extending about substantially the entire circumference of said head and means detachably securing the opposite ends of said band to head.

5. A racket frame as set forth in claim 4 further comprising at least one elongated weight strip located in said groove and maintained therein by said band.

6. A racket frame as set forth in claim 5, further comprising additional weight strips disposed in said groove each of which is corrugated transversely of the length thereof whereby said weight strips may be overlapped to any desirable degree and held against relative lengthwise movement by said corrugations.

* * * * *